US006997514B2

(12) United States Patent
Tarantino et al.

(10) Patent No.: US 6,997,514 B2
(45) Date of Patent: Feb. 14, 2006

(54) E.V.A. FURNITURE

(75) Inventors: Lawrence J. Tarantino, Millstone, NJ (US); Sharon A. Tarantino, Millstone, NJ (US)

(73) Assignees: Lawrence J Tarantino, Millstone, NJ (US); Sharon Tarantino, Millstone, NJ (US)

( * ) Notice: Subject to any disclaimer, the term of this patent is extended or adjusted under 35 U.S.C. 154(b) by 0 days.

(21) Appl. No.: 10/757,018

(22) Filed: Jan. 14, 2004

(65) Prior Publication Data

US 2004/0201269 A1 Oct. 14, 2004

Related U.S. Application Data

(63) Continuation-in-part of application No. 10/004,021, filed on Nov. 2, 2001, now abandoned.

(51) Int. Cl.
*A47C 7/16* (2006.01)

(52) U.S. Cl. ..... 297/451.8; 297/440.14; 297/446.1; 297/DIG. 1

(58) Field of Classification Search ..... 297/440.14, 297/445.1, 446.1, 447.1, 451.8, 451.12, DIG. 1
See application file for complete search history.

(56) References Cited

U.S. PATENT DOCUMENTS

| | | | | | |
|---|---|---|---|---|---|
| 3,743,353 | A | * | 7/1973 | Lupinsky | 297/451.8 |
| 4,067,615 | A | * | 1/1978 | Gehry | 297/451.8 |
| 4,235,473 | A | * | 11/1980 | Aginar | 297/440.19 |
| 4,868,940 | A | * | 9/1989 | Masadi | 5/417 |
| 5,240,528 | A | * | 8/1993 | Pagni | 156/79 |
| 5,286,089 | A | * | 2/1994 | Goldman | 297/452.26 |
| 5,407,248 | A | * | 4/1995 | Jay et al. | 297/284.1 |
| 5,423,597 | A | * | 6/1995 | Rogers | 297/440.1 |
| 5,971,165 | A | * | 10/1999 | Levins | 211/43 |

FOREIGN PATENT DOCUMENTS

JP 56115258 A * 10/1981

* cited by examiner

*Primary Examiner*—Rodney B. White
*Assistant Examiner*—Joe Edell

(57) ABSTRACT

The invention herein disclosed is furniture comprised of a closed-cell foam known as ethylene vinyl acetate, herein known as E.V.A. This new use of E.V.A. material provides structural integrity when various shapes are laminated together. The designs are based upon modular units that provide efficiency in fabrication as well as versatility in use.

6 Claims, 3 Drawing Sheets

E.V.A. FURNITURE

BACKGROUND OF THE INVENTION

This application is a Continuation in Part of application Ser. No. 10/004,021 filed Nov. 02, 2001 now abandoned. The present invention relates generally to modular furniture and, more particularly, to new and improved modular furniture designs using ethylene vinyl acetate as the material for the construction of furniture.

DESCRIPTION OF THE RELATED ART

Traditionally, furniture designs have utilized wood, metal or a foam core to provide stability and structure for the furniture form. The furniture frames are typically covered with foam padding and then fabric upholstery is stretched over the padding. The inventors are unaware of any furniture where the foam is the structure, as well as, the exposed final finish. Additionally, other furniture designs with laminated materials do not offer both structural capabilities and at the same time a soft resilient seating surface.

The following patents are pertinent to this invention: U.S. Pat. No. 5,240,528, Pagni, Larry P.; U.S. Pat. No. 4,822,661, Battaglia, Gino; and U.S. Pat. No. 4,666,947, Brichta et al. Brichta teaches furniture formed from slabs of EVA foam having a density of 38 kg/m3. Pagni teaches a furniture piece 10 consisting of a plurality of stone tile members that are adhesively butt-joining to form planar panel members (FIGS. 1 and 3, column 3, lines 50–65). Pagni also teaches the large structural rigidity of a plurality of smaller tiles and being cut to the requisite size to form the different surfaces of the furniture object which is desired of the furniture piece (column 4, lines 14–20).

DESCRIPTION OF THE RELATED ART

Pagni teaches the panel being cut to the specific size to form the different surfaces of the furniture object which is desired and the surfaces being grinded to a smooth finish (column 3, lines 60–65, column 4, lines 13–14). Battaglia, teaches that panels are cut to specific size by band saw.

SUMMARY OF THE INVENTION

The proposed furniture in accordance with the invention can be produced in a wide variety of forms using ethylene vinyl acetate, herein referred to as E.V.A, and other suitable polymer materials having similar properties.

E.V.A. is a closed-cell, dense resilient foam that is unique in the field of present furniture design applications. It is commonly used in the production of mouse pads, shoes, automotive parts, athletic equipment padding and mats, as well as children's two-dimensional toys. However, it has not been found that E.V.A. has been used in the construction of furniture design. The development of the furniture design potential began with the understanding that the unique physical properties of E.V.A. are structurally capable of supporting human weight and thereby, providing a useful piece of furniture. Because of the material's soft characteristic, the design shape may have square, rectangular, sharp edges without the usual comfort and safety concerns in chairs of other typical materials, i.e. wood, metal or plastic. Additionally, E.V.A. is safe, durable, washable, non-toxic, non-flammable, and can be protected from ultraviolet sunrays.

E.V.A. can be produced in unlimited colors and does not require covering or additional coating or finishing. Other foam chairs presenting available have a plastic coating and/or fabric covering. These unique physical properties of the E.V.A. material provide opportunities in

SUMMARY OF THE INVENTION furniture design for children, as well as adults. The furniture fabrication process begins with manufacturing the E.V.A. raw material in various densities that are identified by the manufacturing industry in weight. The inventors have determined that the preferred density for the production of chairs is 40 kg/cubic meter because it provides adequate strength to support weight and durability. However, a range of 24–128 kg/cubic meter in densities may be utilized. E.V.A. is manufactured in a thickness of approximately 120 mm and is referred to in the industry as a bun. The inventors have developed a formula that relates the thickness of E.V.A. sheets and proportion of the furniture to the user, i.e. size and weight of the person. The thicknesses of the E.V.A. sheet=1 unit and 3 units=1 module. These units and modules can increase or decrease depending upon the size chair desired. In the case of a child's chair, the unit size (E.V.A. sheet thickness) would be approximately 30 mm and an adult full-scale chair would be 40 mm.

Once the exact thickness of the E.V.A. has been determined, the bun is trimmed into sheets and then the shapes are die-cut into a nested pattern. The nested pattern provides a cost effective method of fabrication with minimal material waste. The die-cut E.V.A. pieces are then laminated together with adhesive and then ground to a smooth finish.

Because the design is based upon a modular formula the chairs can be easily stacked in various configurations. Also, because the E.V.A. has a smooth suede-like finish it provides friction that keeps the stacking chairs in place. The interlocking stacking options are particularly useful for a child's chair where up to eight (8) chairs can be safely stacked on top of each other. Also, the child's chair is light enough (approximately 3 lbs.) so that a child can carry it while not damaging anything or anyone it his or her path.

FABRICATION AND MARKETING

After the filing of application Ser. No. 10/004,021 on Nov. 02, 2001, contacts were made to manufacture and market the invention. The effort was rewarded with unexpected commercially successful sales and unexpected design awards as evidenced in the attached affidavit.

DESCRIPTION OF THE DRAWINGS

Drawing Sheet 1–3 represents two perspective views (FIG. 1 and FIG. 2) of a child's chair design option and one exploded view (FIG. 3).

Drawing Sheet 2–3 represents one stacking option (FIG. 4) with eight (8) interlocking chairs, as illustrated on Drawing Sheet 1–3.

Drawing Sheet 3—3 represents a front and side perspective view (FIG. 6) of a child's table design option according to the present invention. The reverse side and back views are identical.

Figure 3:
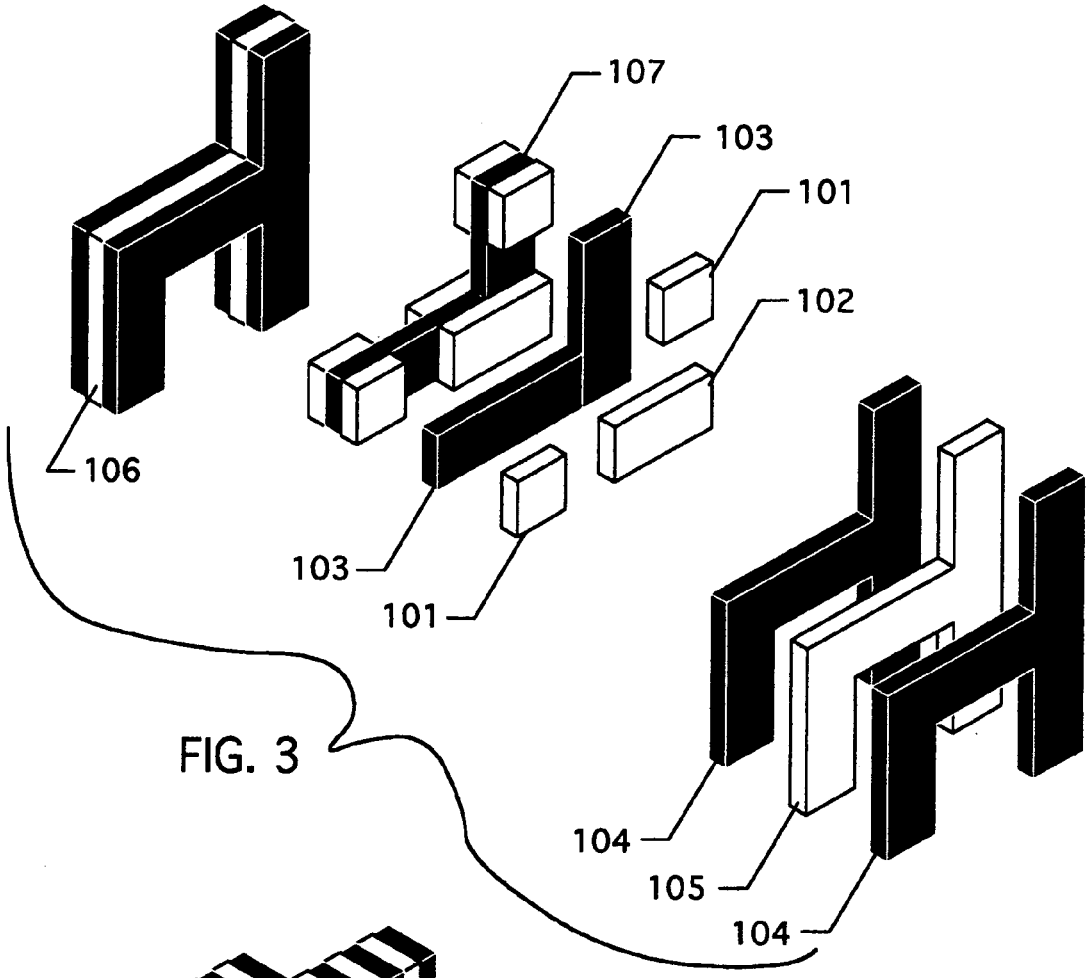
FIG. 3 is an isometric drawing, partially exploded view of one preferred embodiment of an article of furniture according to the present invention. Reference #101–107 represent individual E.V.A. pieces that are required in order to fabricate one chair. The E.V.A. layered pieces represented in FIG. 3 are 30 mm thick and the black and white pieces represent alternating colors. The attachment method of E.V.A. layers is by adhesive lamination.
Figure 2:
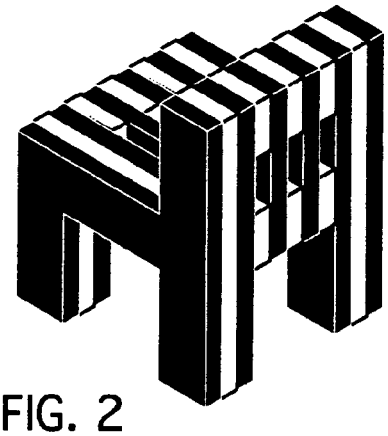
FIG. 2 is a back and reverse side view perspective of a chair design, according to the present invention.
Figure 1:
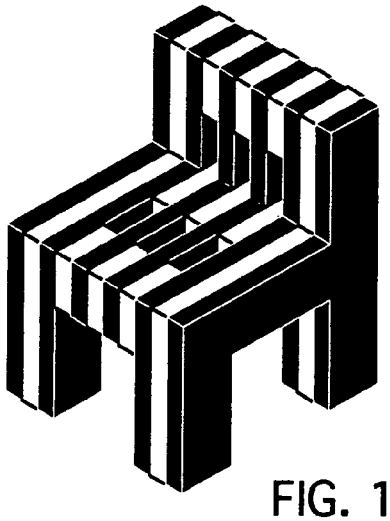
FIG. 1 is a front and side view perspective of a chair design, according to the present invention.
Figure 4:
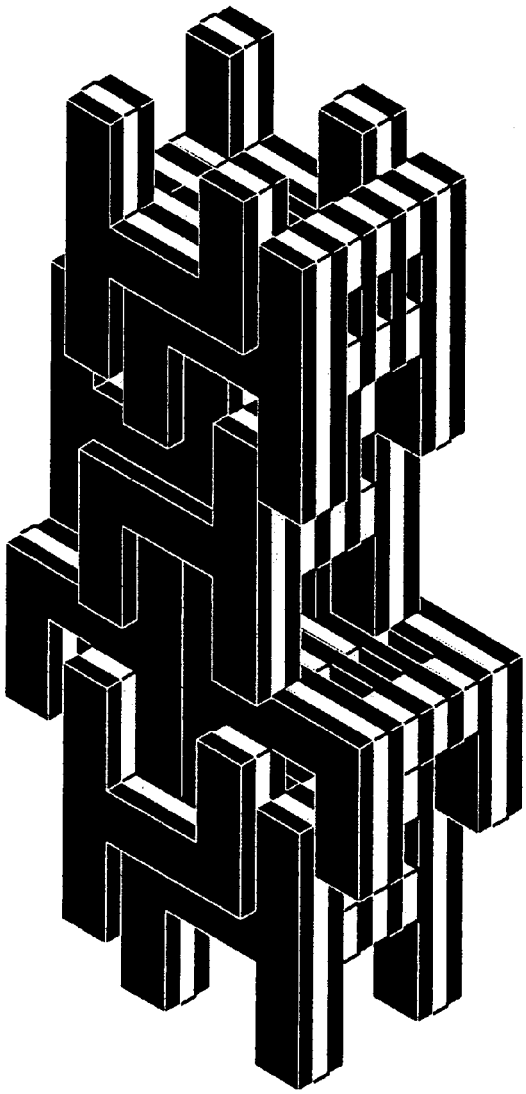
Figure 5:
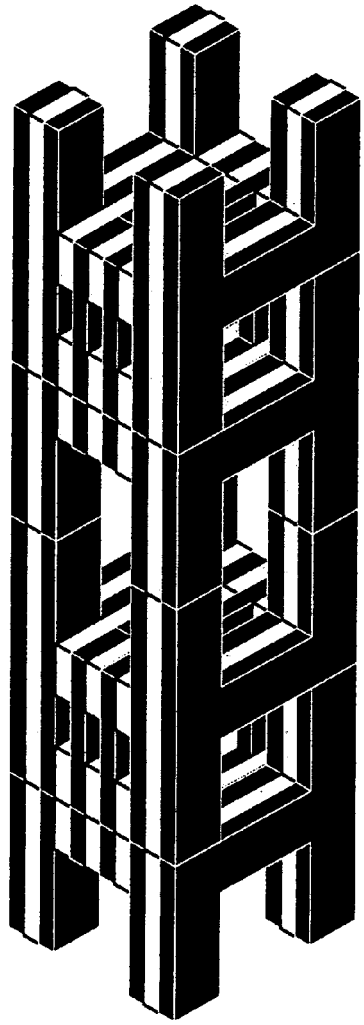
FIG. 5 represents another stacking option with the same four (4) chairs.
Figure 7:
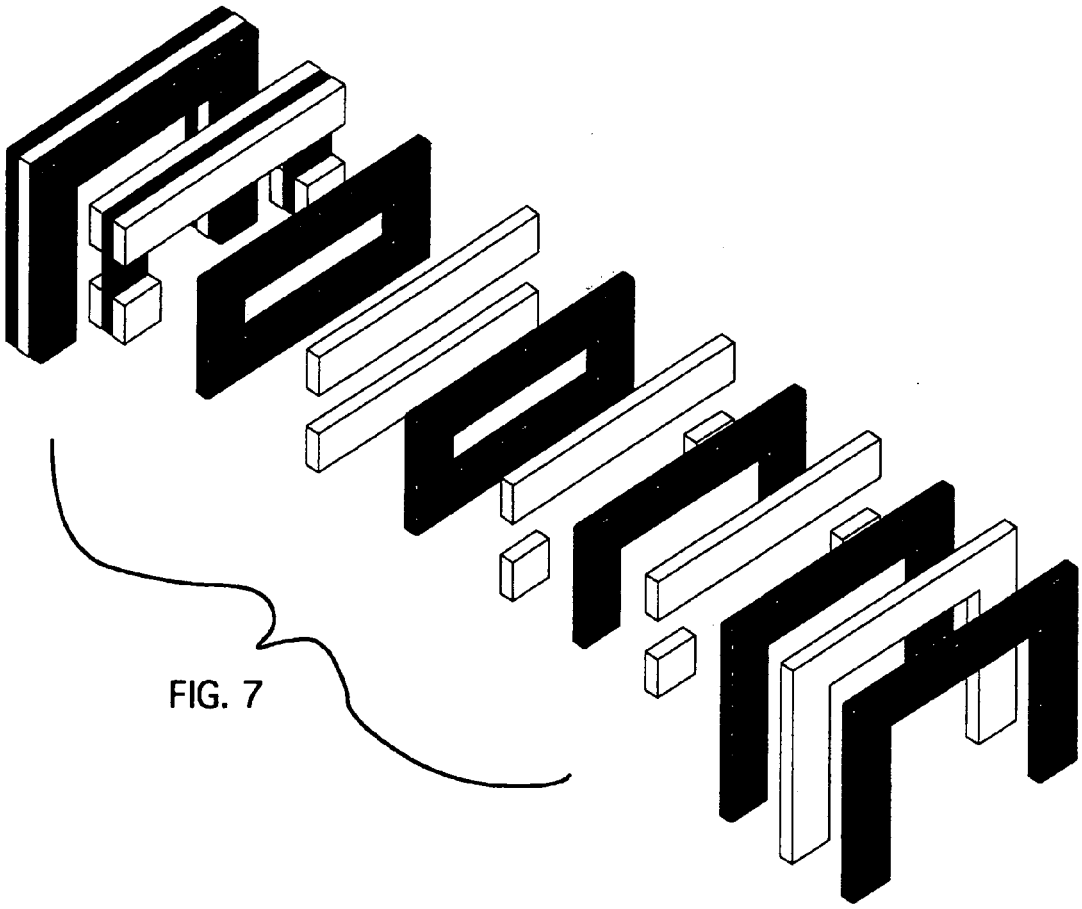
FIG. 7 is an isometric drawing, partially exploded view with representing individual E.V.A. pieces required in order to fabricate one table. The E.V.A. layered pieces represented in FIG. 7 are 30 mm thick and the black and white pieces represent alternating colors. The attachment method of E.V.A. layers is by adhesive lamination.
Figure 6:
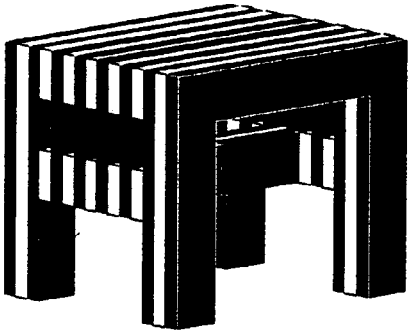

We claim:

1. A modularly designed article of furniture comprising:

a first leg support portion consisting essentially of a plurality of slabs of the same length of ethylene vinyl acetate foam bonded to one another by adhesive lamination wherein each of the plurality of slabs of the first leg support portion includes a first horizontal support member with first and second ends and a first pair of vertical leg members downwardly projection from the first and second ends of the first horizontal support member, a second leg support portion consisting essentially of a plurality of slabs of the same length of ethylene vinyl acetate foam bonded to one another by adhesive lamination wherein each of the plurality of slabs of the second leg support portion includes a second horizontal support member with first and second ends and a second pair of vertical leg members downwardly projection from the first and second ends of the second horizontal support member, a seating portion consisting essentially of a plurality of slabs of different lengths of ethylene vinyl acetate foam bonded to one another along their lengths by adhesive lamination to form a seating area such that the different lengths of the plurality of slabs form apertures extending through the seating area wherein the seat member has a first laterally extending edge bonded to the first leg support portion by adhesive lamination and a second laterally extending edge bonded to the second leg support portion, and wherein the plurality of slabs of ethylene vinyl acetate foam of the first leg support portion, the second leg support portion, and the seating portion being of a density ranging from 35 to 45 kg/m$^3$ or supporting the weight of a seated user.

2. The modularly designed article of furniture of claim 1, wherein the plurality of slabs of ethylene vinyl acetate foam are formed to a specific size by die-cut or band saw then adhesively laminated and ground to a smooth finish.

3. The modularly designed article of furniture of claim 1, wherein a plurality of the modularly designed articles of furniture are capable of being stacked and interlocked with one another.

4. The modularly designed article of furniture of claim 1, wherein the plurality of slabs of ethylene vinyl acetate foam of the first leg support portion, the second leg support portion, and the seating portion being of alternating colors.

5. The modularly designed article of furniture of claim 1, wherein each of the plurality of slabs of ethylene vinyl acetate foam is a desired thickness based upon the scale of the article of furniture.

6. The modularly designed article of furniture of claim 1, wherein the plurality of slabs of ethylene vinyl acetate foam of the first leg support portion, the second leg support portion, and the seating portion include vertical extending portions forming a seatback.

* * * * *